US007143868B1

(12) United States Patent
Christen et al.

(10) Patent No.: US 7,143,868 B1
(45) Date of Patent: Dec. 5, 2006

(54) UNDERDECK PONTOON LIFT SYSTEM

(76) Inventors: Michael T. Christen, P.O. Box 1681, Detroit Lakes, MN (US) 56502; Mark C. Christen, P.O. Box 831, Detroit Lakes, MN (US) 56502

( * ) Notice: Subject to any disclaimer, the term of this patent is extended or adjusted under 35 U.S.C. 154(b) by 294 days.

(21) Appl. No.: 10/796,840

(22) Filed: Mar. 8, 2004

(51) Int. Cl.
*B66F 7/00* (2006.01)

(52) U.S. Cl. ..... 187/203; 187/263; 187/259; 187/266; 114/44; 114/45; 114/344

(58) Field of Classification Search ..... 187/203, 187/263, 259, 266; 114/44, 45
See application file for complete search history.

(56) References Cited

U.S. PATENT DOCUMENTS

| | | | | |
|---|---|---|---|---|
| 4,072,119 | A | 2/1978 | Williams | 114/45 |
| 4,226,202 | A | 10/1980 | Conrad | 114/48 |
| 4,509,446 | A | 4/1985 | Sutton | 114/45 |
| 4,615,289 | A | 10/1986 | Bloxham | 114/45 |
| 4,708,081 | A | 11/1987 | Amirikian | 114/230 |
| 4,732,102 | A | 3/1988 | Holman et al. | 114/45 |
| 5,099,778 | A | 3/1992 | Palen | 114/45 |
| 5,224,569 | A * | 7/1993 | Hewitt et al. | 187/259 |
| 5,240,347 | A | 8/1993 | Williams et al. | 405/3 |
| 6,032,601 | A | 3/2000 | Gates | 114/45 |
| 6,131,528 | A | 10/2000 | Meek et al. | 114/44 |
| 6,241,048 | B1 * | 6/2001 | Heilmann | 187/263 |
| 6,257,167 | B1 * | 7/2001 | Joaquim | 114/344 |
| 6,612,775 | B1 * | 9/2003 | Hewitt | 405/3 |
| 6,823,808 | B1 * | 11/2004 | Clary | 114/44 |
| 6,837,651 | B1 * | 1/2005 | Basta | 405/3 |

OTHER PUBLICATIONS

Pontoon Boat Lifts, Schmidtboatlifts-docks.com, Feb. 28, 2004, Website Printout, 3 pages.
The Aluminum Underdeck Pontoon Lift, Ezroll.com, Jan. 8, 2004, Website Printout, 2 pages.
Image Printouts, Harbor-master.com, Jan. 8, 2004, Website Printout, 1 page.
Image Printouts, Hewitt-roll-a-dock.com, Jan. 8, 2004, Website Printout, 3 pages.
Pontoon Lifts, Portadock.com, Jan. 8, 2004, Website Printout, 1 page.

* cited by examiner

*Primary Examiner*—Kathy Matecki
*Assistant Examiner*—Terrell Matthews

(57) ABSTRACT

An underdeck pontoon lift system for supporting pontoons of various sizes in a stable manner. The underdeck pontoon lift system includes a base structure, a plurality of front lifting jacks and a rear lifting jack pivotally attached to the base structure, a support bed pivotally attached to the lifting jacks, a front structure extending from the base structure, and an elevating unit for manipulating the lifting jacks. The lifting jacks preferably have an inverted U-shaped base member with a pair of support members extending upwardly, where the width of the support members is less than the width of the base member. The lifting jacks are preferably attached to cross members that extend between side members of the base structure. The support bed preferably has a rear tapered portion for assisting in the loading of a pontoon.

17 Claims, 8 Drawing Sheets

UNDERDECK PONTOON LIFT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to pontoon lifts and more specifically it relates to an underdeck pontoon lift system for supporting pontoons of various sizes in a stable manner.

2. Description of the Related Art

Pontoon lifts have been in use for years. Many pontoon lifts utilize a cantilever structure for lifting a pontoon above a water surface. There are also vertical lifts that are capable of elevating a pontoon. Pontoon lifts may either engage the underdeck or the floats for elevating the pontoon.

One of the problems with underdeck pontoon lifts is that they are not suitable for the newer pontoons that have larger diameter floats (e.g. 25 or 27 inches). Conventional underdeck pontoon lifts have a support bed that is typically 48 inches wide which may engage and damage the interior surfaces of the floats. In addition, conventional support beds for pontoon lifts merely have a straight structure and do not provide a tapered loading area to assist in guiding the pontoon upon the support bed.

While these devices may be suitable for the particular purpose to which they address, they are not as suitable for supporting pontoons of various sizes in a stable manner. Conventional pontoon lifts are not suitable for supporting newer pontoons that have larger diameter floats.

In these respects, the underdeck pontoon lift system according to the present invention substantially departs from the conventional concepts and designs of the prior art, and in so doing provides an apparatus primarily developed for the purpose of supporting pontoons of various sizes in a stable manner.

BRIEF SUMMARY OF THE INVENTION

In view of the foregoing disadvantages inherent in the known types of pontoon lifts now present in the prior art, the present invention provides a new underdeck pontoon lift system construction wherein the same can be utilized for supporting pontoons of various sizes in a stable manner.

The general purpose of the present invention, which will be described subsequently in greater detail, is to provide a new underdeck pontoon lift system that has many of the advantages of the pontoon lifts mentioned heretofore and many novel features that result in a new underdeck pontoon lift system which is not anticipated, rendered obvious, suggested, or even implied by any of the prior art pontoon lifts, either alone or in any combination thereof.

To attain this, the present invention generally comprises a base structure, a plurality of front lifting jacks and a rear lifting jack pivotally attached to the base structure, a support bed pivotally attached to the lifting jacks, a front structure extending from the base structure, and an elevating unit for manipulating the lifting jacks. The lifting jacks preferably have an inverted U-shaped base member with a pair of support members extending upwardly, where the width of the support members is less than the width of the base member. The lifting jacks are preferably attached to cross members that extend between side members of the base structure. The support bed preferably has a rear tapered portion for assisting in the loading of a pontoon.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an underdeck pontoon lift system that will overcome the shortcomings of the prior art devices.

A second object is to provide an underdeck pontoon lift system for supporting pontoons of various sizes in a stable manner.

Another object is to provide an underdeck pontoon lift system that is capable of supporting pontoons with floats having larger diameters (e.g. 25", 27").

An additional object is to provide an underdeck pontoon lift system that reduces wear and damage to floats.

A further object is to provide an underdeck pontoon lift system that provides a stable base.

Another object is to provide an underdeck pontoon lift system that provides a tapered front loading area to assist in loading of a pontoon.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
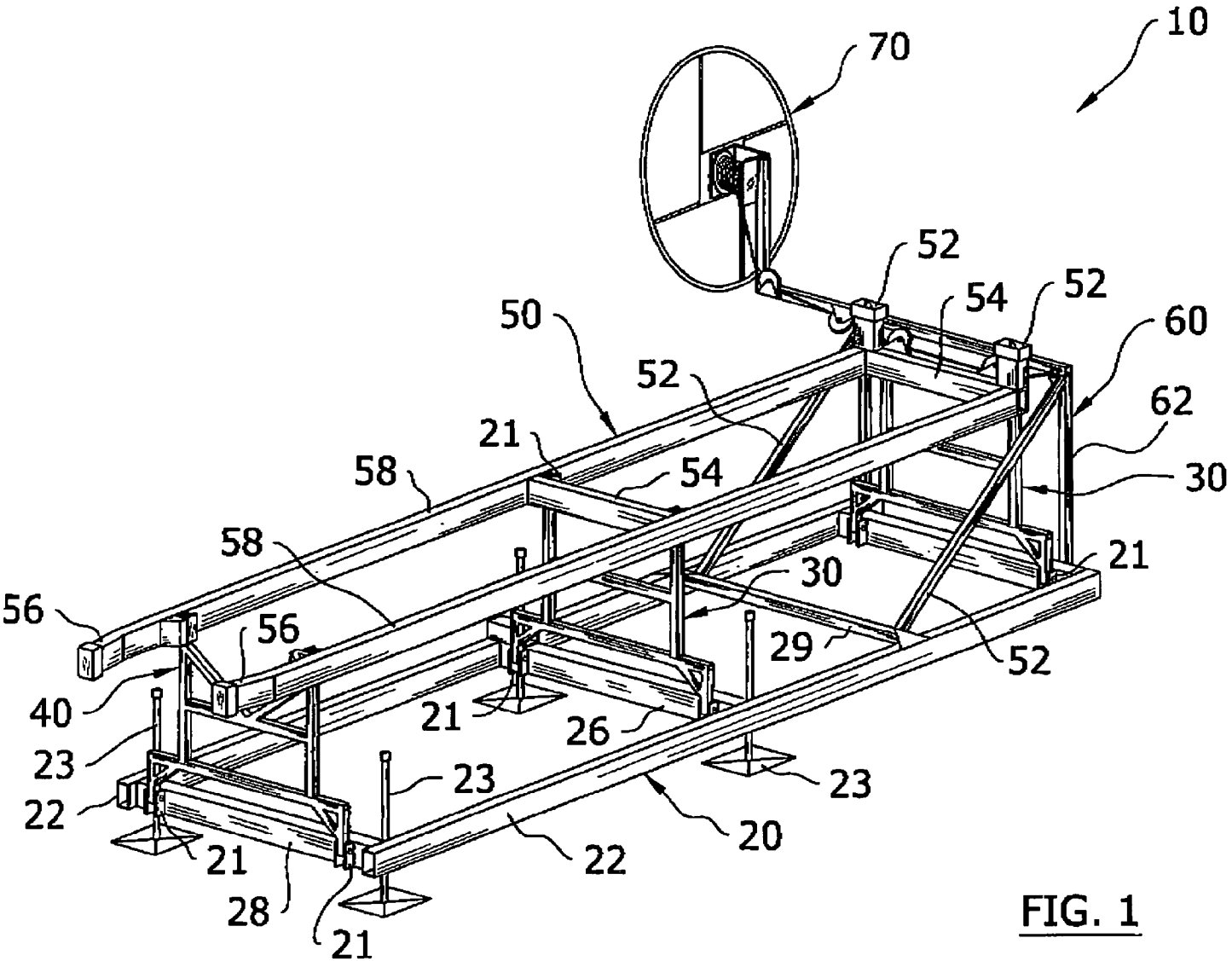
FIG. 1 is an upper perspective view of the present invention.

Turning now descriptively to the drawings, in which similar reference characters denote similar elements throughout the several views, FIGS. 1 through 8 illustrate an underdeck pontoon lift system 10, which comprises a base structure 20, a plurality of front lifting jacks 30 and a rear lifting jack 40 pivotally attached to the base structure 20, a support bed 50 pivotally attached to the lifting jacks, a front structure 60 extending from the base structure 20, and an elevating unit 70 for manipulating the lifting jacks. The lifting jacks 30, 40 preferably have an inverted U-shaped base member 32 with a pair of support members 34 extending upwardly, where the width of the support members 34 is less than the width of the base member 32. The lifting jacks 30, 40 are preferably attached to cross members that extend between side members 22 of the base structure 20. The support bed 50 preferably has a rear tapered portion 56 for assisting in the loading of a pontoon 12.

B. Base Structure

Figure 3:
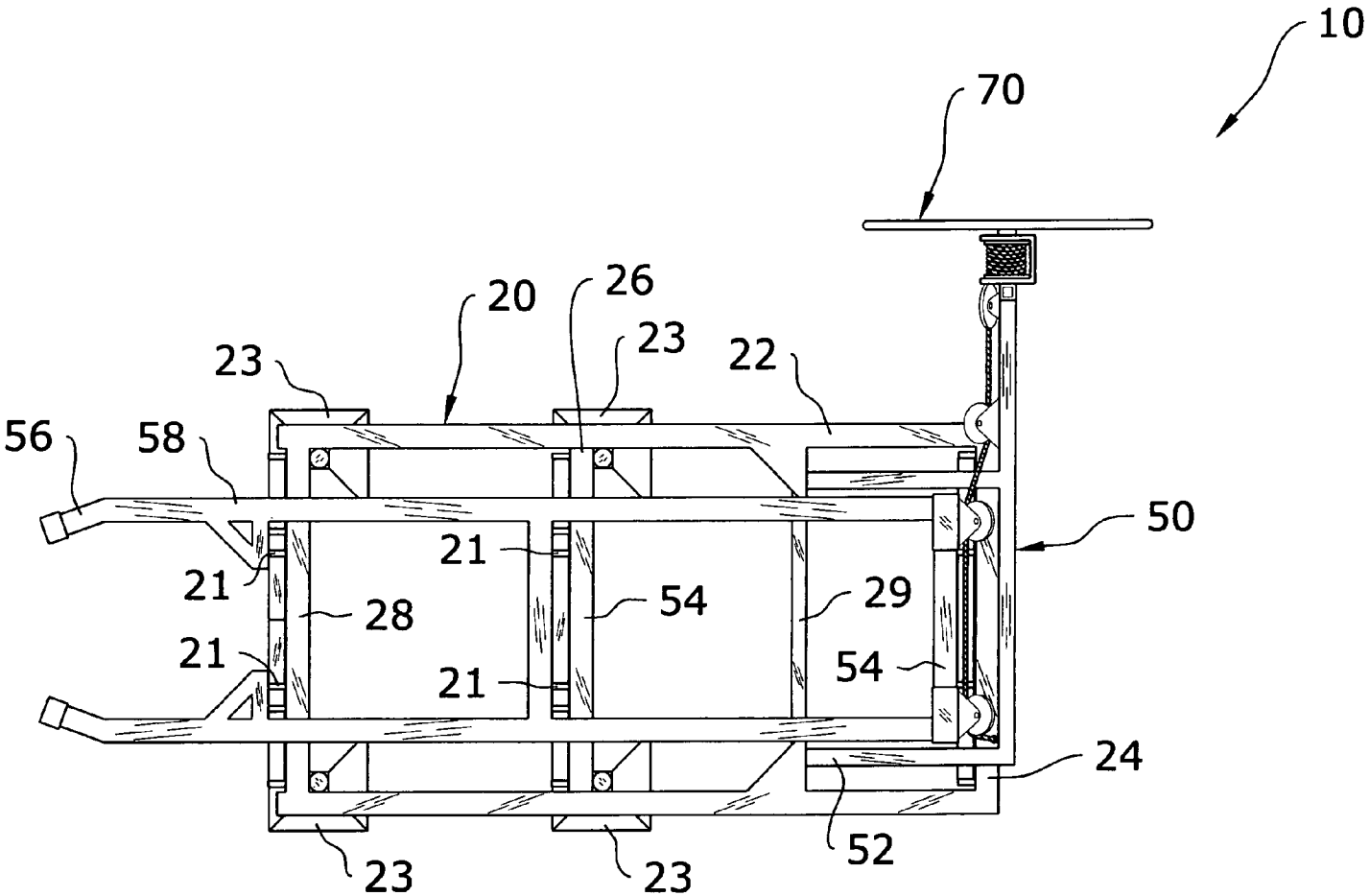
FIG. 3 is a top view of the present invention.
Figure 4:
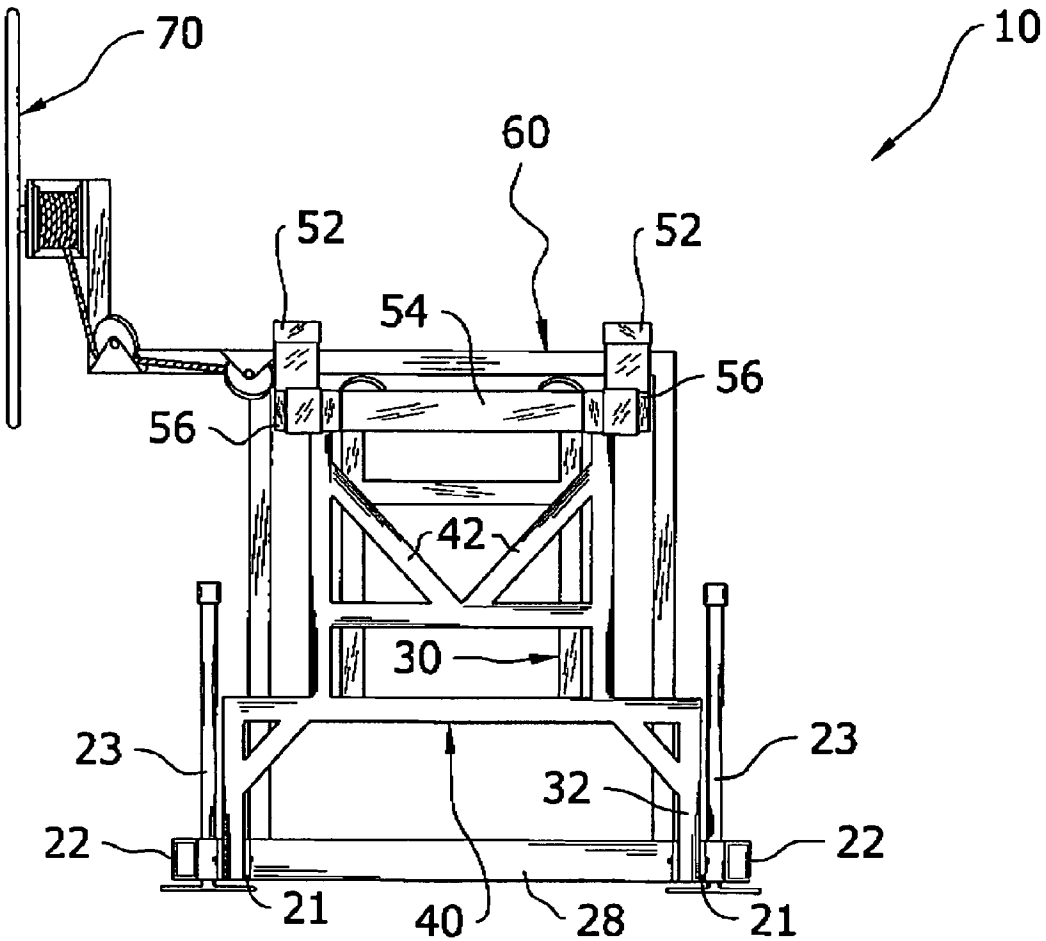
FIG. 4 is a rear view of the present invention.
Figure 5:
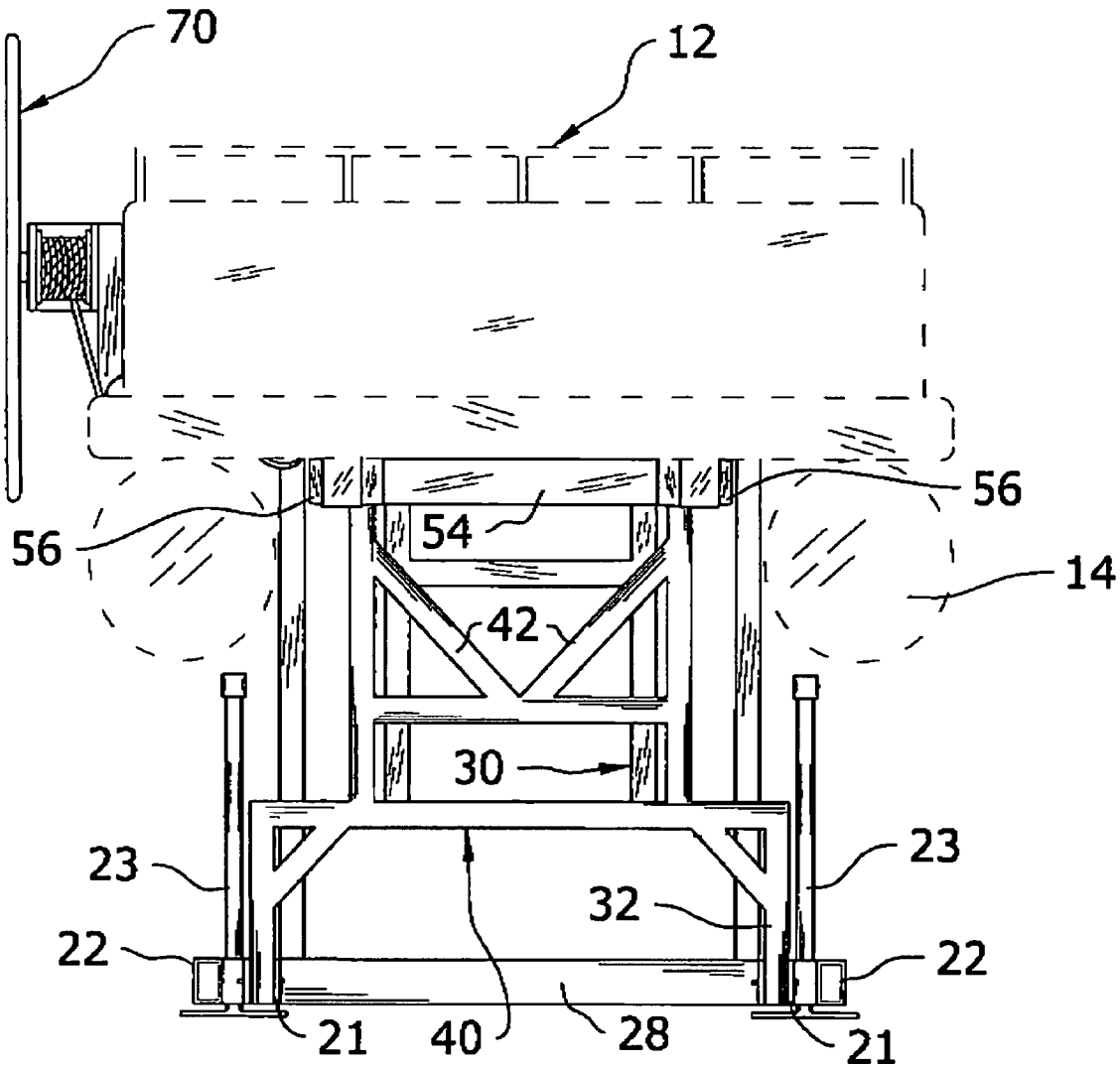
FIG. 5 is a rear view of the present invention supporting a pontoon.
Figure 6:
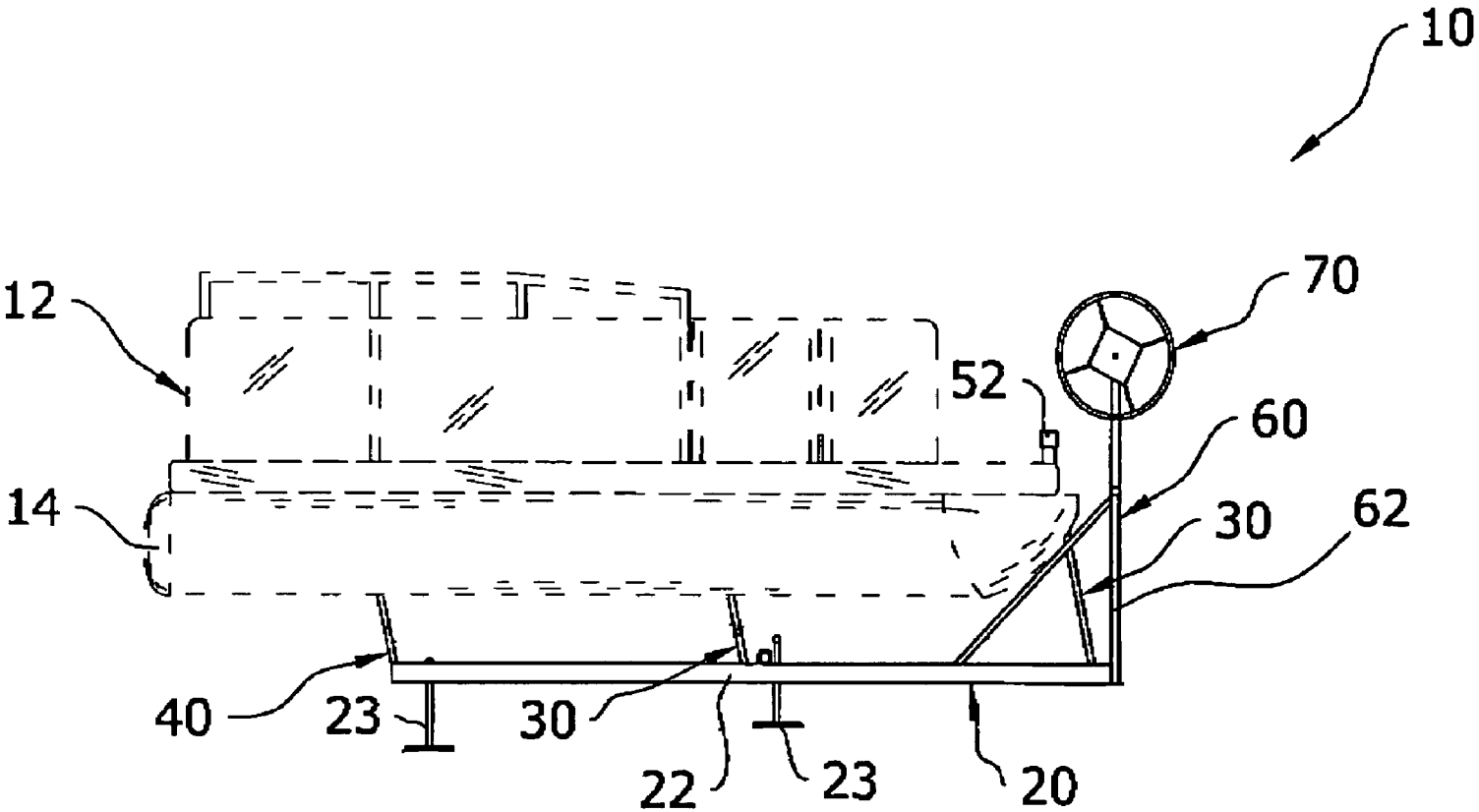
FIG. 6 is a side view of the present invention supporting a pontoon.

The base structure 20 preferably has an elongated rectangular structure as shown in FIG. 3 of the drawings. The base preferably has a plurality of cross members 24, 26, 28 extending between a pair of side members 22 that the lifting jacks 30, 40 are pivotally attached to as best shown in FIG. 1 of the drawings. The base has a width greater than the lifting jacks 30, 40 and the support bed 50 as best illustrated in FIG. 4 of the drawings.

The base structure 20 may include a plurality of leveling legs 23 for allowing the user to level the lift system 10. The base structure 20 may also include wheels for assisting in the entry and removal of the lift system 10 from the water. Various other structures may be added to the base structure 20 that are commonly utilized in the lift industry.

C. Lifting Jacks

The plurality of lifting jacks 30, 40 are preferably comprised of a plurality of front lifting jacks 30 and at least one rear lifting jack 40 as shown in FIG. 1 of the drawings. The lifting jacks 30, 40 each are preferably comprised of an inverted U-shaped base member 32 and a pair of support members 34 extending upwardly from the base member 32 as shown in FIGS. 7 and 8 of the drawings.

A third width of the support members 34 is preferably at least 30 percent less than a fourth width of the base member 32. The third width is preferably between 31 inches to 36 inches and the fourth width is preferably approximately 49.5 inches. The applicant has found that these dimensions are desired for supporting pontoons with various sizes of floats 14.

Figure 7:
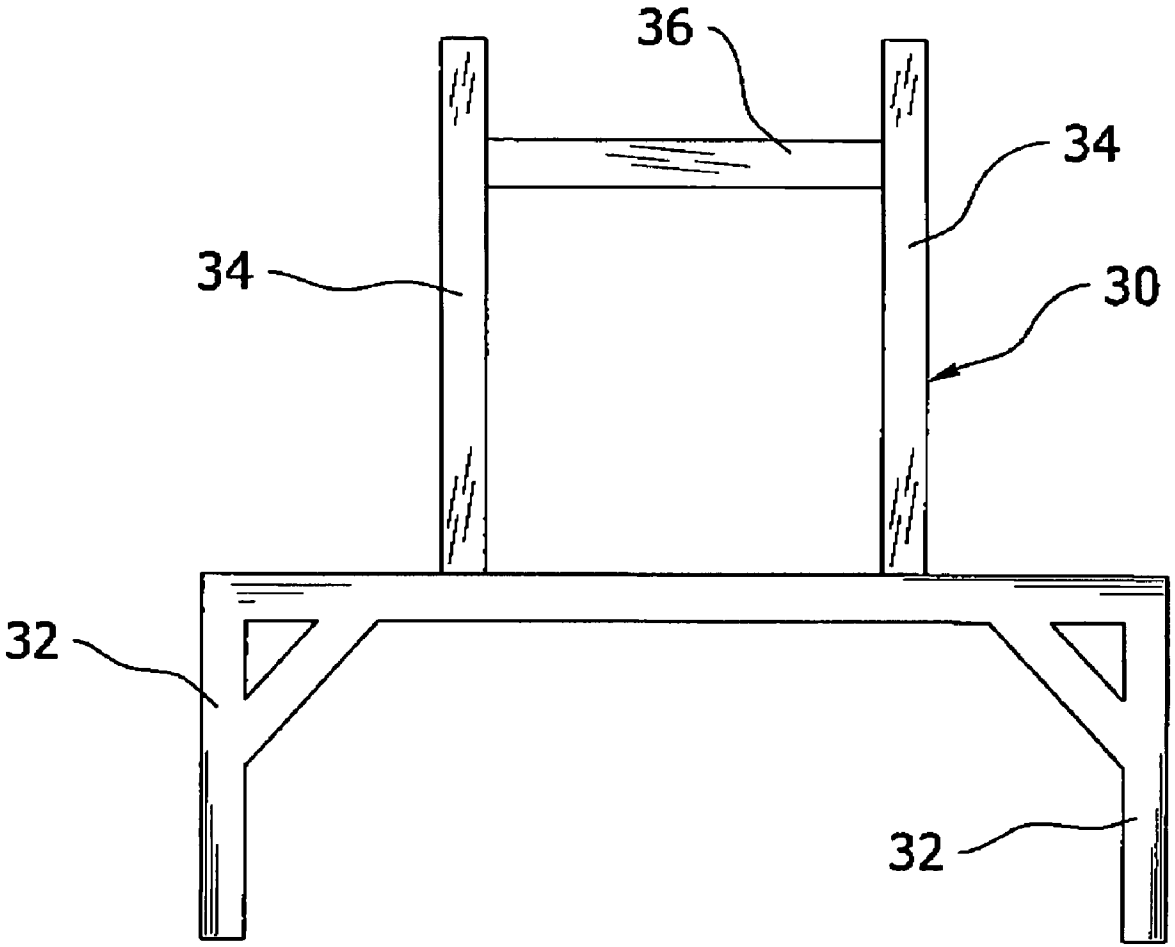
FIG. 7 is a rear view of the front lifting jack.
Figure 8:
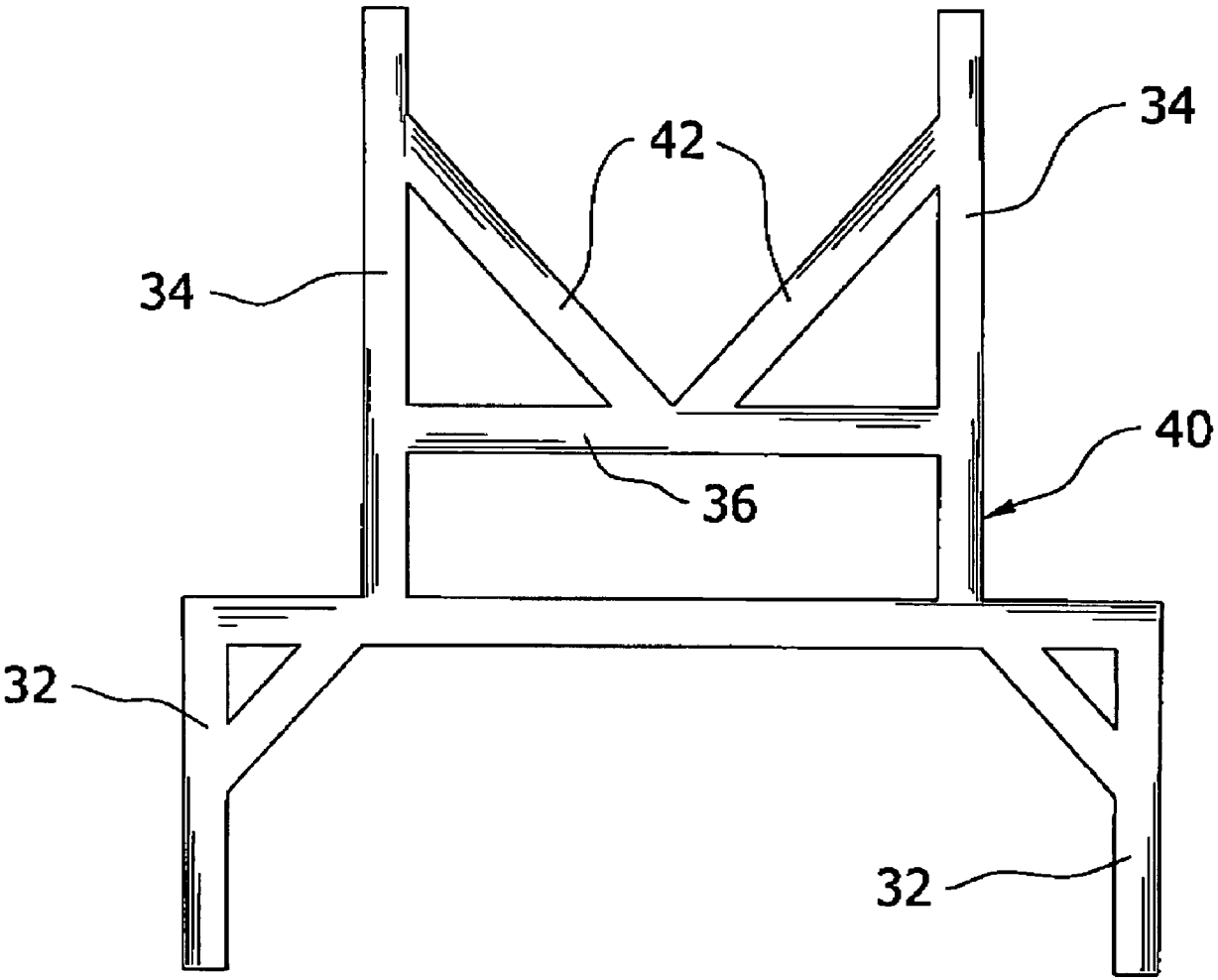
FIG. 8 is a rear view of the rear lifting jack.

The lifting jacks 30, 40 preferably include at least one support cross member 36 extending between the support members 34 as further shown in FIGS. 7 and 8 of the drawings. The rear lifting jack 40 preferably includes a pair of angled members 42 extending between the support cross member 36 and the support members 34 as shown in FIG. 8 of the drawings.

The lifting jacks 30, 40 are pivotally attached to corresponding cross members 24, 26, 28 that extend between a pair of side members 22 of the base structure 20 as shown in FIG. 1 of the drawings. The front lifting jacks 30 are pivotally attached to bed cross members 54 that extend between a pair of rails 58 of the support bed 50 as further shown in FIG. 1 of the drawings. The rear lifting jack 40 is preferably pivotally attached to the rails 58 of the support bed 50 thereby eliminating the need for a cross member in the rear portion of the support bed 50.

D. Support Bed

The support bed 50 is pivotally attached to the upper end of the lifting jacks opposite of the base structure 20 in a cantilever manner. The support bed 50 has a pair of rails 58 with a plurality of bed cross members 54 extending between thereof. One or more stop members 52 may extend upwardly from a front portion of the support bed 50 for limiting the movement of the pontoon 12 upon the support bed 50. The support bed 50 preferably includes a rear tapered portion 56 that tapers inwardly for assisting in loading of a pontoon 12 as best shown in FIGS. 1 and 3 of the drawings.

The support bed 50 preferably has a first width that is at least 20 percent less than a second width of the base structure 20. The first width is preferably approximately 43 inches which the applicant has discovered is desired for fitting between floats 14 of various sizes, including larger sized floats 14 (e.g. 25 inches, 27 inches). The second width of the base structure 20 is preferably approximately 60 inches which provides the desired support for the lift system 10 while providing a narrow support bed 50.

E. Front Structure

Figure 2:
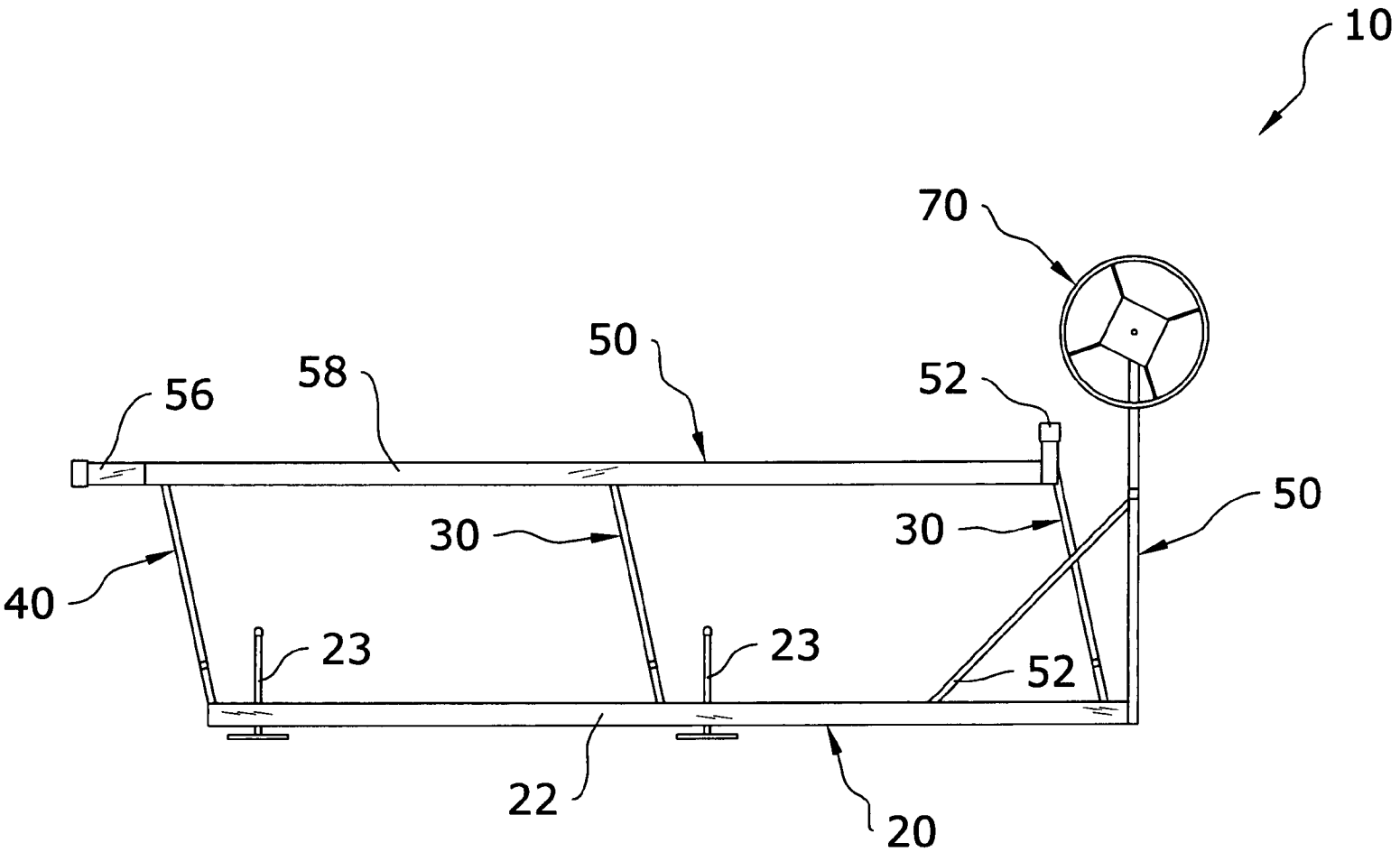
FIG. 2 is a side view of the present invention.

The front structure 60 extends upwardly from the base structure 20 as shown in FIGS. 1 and 2 of the drawings. The front structure 60 includes a pair of front support members 62 attached to a supporting cross member 29 of said base structure 20 as further shown in FIG. 1 of the drawings. The front support members 62 preferably have a width less than the base structure 20 as shown in FIG. 3 of the drawings.

F. Elevating Unit

The elevating unit 70 is attached to the front structure 60 for manipulating the lifting jacks from a lowered position to a raised position. The elevating unit 70 may be manually operated (e.g. wheel) or motorized. As is well known in the art of lifts, a cable may extend from the elevating unit 70 and through a series of pulleys attached to the front structure 60 and the front lifting jack and/or support bed 50. The end of the cable is preferably attached to the front structure 60 as shown in FIGS. 1 and 3 of the drawings.

The operation of the elevating unit 70 within the present invention is similar to conventional lift units. When the cable of the elevating unit 70 is extended out, the lifting jacks 30, 40 then pivot rearwardly together thereby lowering the support bed 50 and the pontoon 12. When the cable of the elevating unit 70 is drawn in, the lifting jacks 30, 40 then pivot forwardly together thereby raising the support bed 50 and the pontoon 12.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. An underdeck pontoon lift system, comprising:

a base structure;

a plurality of lifting jacks pivotally attached to said base structure, said lifting jacks comprised of a plurality of front lifting jacks and at least one rear lifting jack;

a support bed pivotally attached to said lifting jacks opposite of said base structure in a cantilever manner, wherein said support bed has a first width that is at least 20 percent less than a second width of said base structure;

wherein said lifting jacks each are comprised of an inverted U-shaped base member and a pair of support members extending upwardly from said base structure, wherein a third width of said support members is at least 30 percent less than a fourth width of said inverted U-shaped base member;

a front structure extending upwardly from said base structure; and an elevating unit attached to said front structure for manipulating said lifting jacks from a lowered position to a raised position.

2. The underdeck pontoon lift system of claim 1, wherein said first width is approximately 43 inches.

3. The underdeck pontoon lift system of claim 1, wherein said second width of said base structure is approximately 60 inches.

4. The underdeck pontoon lift system of claim 1, wherein said first width is approximately 43 inches and wherein said second width of said base structure is approximately 60 inches.

5. The underdeck pontoon lift system of claim 1, wherein said third width is between 31 inches to 36 inches.

6. The underdeck pontoon lift system of claim 1, wherein said fourth width is approximately 49.5 inches.

7. The underdeck pontoon lift system of claim 1, wherein said third width is between 31 inches to 36 inches and wherein said fourth width is approximately 49.5 inches.

8. The underdeck pontoon lift system of claim 7, wherein said first width is approximately 43 inches and wherein said second width of said base structure is approximately 60 inches.

9. The underdeck pontoon lift system of claim 1, wherein said lifting jacks include at least one support cross member extending between said support members.

10. The underdeck pontoon lift system of claim 9, wherein said rear lifting jack includes a pair of angled members extending between said support cross member and said support members.

11. The underdeck pontoon lift system of claim 1, wherein said support bed includes a rear tapered portion that tapers inwardly for assisting in loading of a pontoon.

12. The underdeck pontoon lift system of claim 1, wherein said lifting jacks are pivotally attached to corresponding cross members that extend between a pair of side members of said base structure.

13. The underdeck pontoon lift system of claim 1, wherein said front lifting jacks are pivotally attached to bed cross members that extend between a pair of rails of said support bed.

14. The underdeck pontoon lift system of claim 13, wherein said rear lifting jack is pivotally attached to said rails of said support bed.

15. The underdeck pontoon lift system of claim 1, wherein said front structure includes a pair of front support members attached to a supporting cross member of said base structure.

16. An underdeck pontoon lift system, comprising:

a base structure;

a plurality of lifting jacks pivotally attached to said base structure, said lifting jacks comprised of a plurality of front lifting jacks and at least one rear lifting jack;

a support bed pivotally attached to said lifting jacks opposite of said base structure in a cantilever manner, wherein said support bed has a first width that is at least 20 percent less than a second width of said base structure;

wherein said support bed includes a rear tapered portion that tapers inwardly for assisting in loading of a pontoon;

wherein said lifting jacks each are comprised of an inverted U-shaped base member and a pair of support members extending upwardly from said base structure, wherein a third width of said support members is at least 30 percent less than a fourth width of said inverted U-shaped base member;

a front structure extending upwardly from said base structure; and an elevating unit attached to said front structure for manipulating said lifting jacks from a lowered position to a raised position.

17. An underdeck pontoon lift system, comprising:

a base structure;

a plurality of lifting jacks pivotally attached to said base structure, said lifting jacks comprised of a plurality of front lifting jacks and at least one rear lifting jack;

a support bed pivotally attached to said lifting jacks opposite of said base structure in a cantilever manner, wherein said support bed has a first width that is at least 20 percent less than a second width of said base structure;

wherein said support bed includes a rear tapered portion that tapers inwardly for assisting in loading of a pontoon;

wherein said lifting jacks each are comprised of an inverted U-shaped base member and a pair of support members extending upwardly from said base structure, wherein a third width of said support members is at least 30 percent less than a fourth width of said inverted U-shaped base member;

a front structure extending upwardly from said base structure; and an elevating unit attached to said front structure for manipulating said lifting jacks from a lowered position to a raised position;

wherein said first width is approximately 43 inches;

wherein said second width of said base structure is approximately 60 inches;

wherein said first width is approximately 43 inches and wherein said second width of said base structure is approximately 60 inches;

wherein said third width is between 31 inches to 36 inches;

wherein said fourth width is approximately 49.5 inches;

wherein said third width is between 31 inches to 36 inches and wherein said fourth width is approximately 49.5 inches;

wherein said first width is approximately 43 inches and wherein said second width of said base structure is approximately 60 inches;

wherein said lifting jacks include at least one support cross member extending between said support members;

wherein said rear lifting jack includes a pair of angled members extending between said support cross member and said support members;

wherein said lifting jacks are pivotally attached to corresponding cross members that extend between a pair of side members of said base structure;

wherein said front lifting jacks are pivotally attached to bed cross members that extend between a pair of rails of said support bed;

wherein said rear lifting jack is pivotally attached to said rails of said support bed;

wherein said front structure includes a pair of front support members attached to a supporting cross member of said base structure.

* * * * *